United States Patent [19]

Ohmukai et al.

[11] 4,365,952

[45] Dec. 28, 1982

[54] LIQUID GAS BURNER

[75] Inventors: Yoshimi Ohmukai, Hirakata; Toshiro Ogino, Osaka; Kinichi Adachi, Takarazuka; Hisanori Nishiguchi, Nayagawa, all of Japan

[73] Assignee: Matsushita Electric Industrial Co., Ltd., Osaka, Japan

[21] Appl. No.: 131,548

[22] Filed: Mar. 18, 1980

[30] Foreign Application Priority Data

Mar. 20, 1979 [JP] Japan ..... 54-32745
Apr. 17, 1979 [JP] Japan ..... 54-47611

[51] Int. Cl.[3] ..... F23D 11/44

[52] U.S. Cl. ..... 431/208; 431/239; 431/241; 239/138; 261/142; 261/107; 48/180 H

[58] Field of Search ..... 431/241, 245, 170, 208, 431/230, 239, 328, 354, 261; 239/138, 326, 145, 144; 48/180 H, 180 F; 261/99, 107, 142, 141, 115

[56] References Cited

U.S. PATENT DOCUMENTS 618,660 1/1899 Gray ..... 431/230
2,109,878 3/1938 Burrell ..... 261/107
3,785,461 1/1974 Rompa ..... 239/326 X
4,153,631 5/1979 Mears, Jr. ..... 261/107 X

FOREIGN PATENT DOCUMENTS 54-124340 9/1979 Japan ..... 431/208

*Primary Examiner*—Samuel Scott
*Assistant Examiner*—Randall L. Green
*Attorney, Agent, or Firm*—Spencer & Kaye

[57] ABSTRACT

A liquid fuel burner for burning liquid fuel in the form of a gaseous mixture with air. The liquid fuel burner has a porous member provided at least with a fuel receiving section for receiving the liquid fuel supplied to the burner and a fuel evaporation section from which the liquid fuel is evaporated. An air supplying device is provided for forcibly supplying air to the fuel evaporation section. The rate of air supply is varied by means of a damper or like means. Heating means are provided for maintaining the fuel evaporation section at a substantially constant temperature. The rate of burning is varied while maintaining the air-fuel ratio of the mixture substantially constant, because the rate of evaporation of the fuel is almost in proportion to the rate of supply of air to the fuel evaporation section. The heating means facilitates the evaporation of the fuel and permits a rapid rise and stabilization of burning after ignition.

4 Claims, 13 Drawing Figures

LIQUID GAS BURNER

BACKGROUND OF THE INVENTION

The present invention relates to a liquid fuel burner of the type having a porous member consisting of a fuel receiving section arranged for receiving a liquid fuel supplied to the burner and an evaporation section in which the liquid fuel coming from the fuel receiving section is evaporated.

Hitherto, many types of liquid fuel burners designed and constructed to perform burning at a constant rate have been used, and various attempts and proposals have been made to maintain such burners at a constant burning rate under varying environmental condition. Namely, in the liquid fuel burner, there is a problem that a fluctuation of the environmental condition causes a change in the burning rate which in turn changes the air-fuel ratio and the temperature of the mixture gas consisting of air and vaporized fuel, resulting in a large fluctuation of the burning characteristic even when the same fuel is used. Thus, it is quite difficult to obtain a so-called clean burning condition in which the mixture is burnt stably at a high quality of burning. The efforts for maintaining a constant burning rate have been attributed to this fact.

The above-mentioned problem occurs also in liquid fuel burners in which the burning rate is controllable. Therefore, the practically usable control range of the burning rate has been restricted inconveniently to a narrow region of, for example, between 6/10 and 1/1.

On the other hand, there is an increasing demand for a wider control range of the burning rate in liquid burners. In addition, the environmental condition is inevitably varied during ordinary use of a liquid fuel burner. Under this circumstance, the conventional liquid fuel burner in which the burning rate is fixed or controllable only within a limited range cannot sufficiently meet the requirement.

In most existing liquid fuel burners of the controllable burning rate type, control of the burning rate is obtained by adjusting the flow rate of the fuel. In such burners, the fuel tends to leak from the adjusting device for adjusting the flow rate of the fuel. The fuel leaking outside the burner causes a bad smell and, in the worst case, may catch fire causing a serious accident. In addition, there is a tendency for the mechanical parts of the adjusting device to be corroded by water or organic acid contained in the fuel. Further, the adjusting device is liable to become inoperative due to sticking caused by tar-like sticky substances or sediments depositing in the adjusting device. Once such inconveniences occur, a safe condition can be restored only through troublesome and time consuming repair work, because it is necessary to disassemble the fuel system. This repair work inevitably causes contamination of the worker, burner and associated instruments as well as the area around the burner. In addition, the assembling has to be done with the greatest care in order to avoid leakage of the fuel.

Recently, a liquid fuel burner has been developed which has a fuel evaporation section incorporating a porous member arranged to be supplied with air, the rate of air supply being controllable. This burner, however, has the following disadvantage.

In this type of the burner, the vapor pressure around the evaporation section is changed in accordance with the change in the flow rate of air, so that the fuel is evaporated from the evaporation section at a rate corresponding to the flow rate of air. It is therefore possible to maintain a constant air-fuel ratio of the mixture irrespective of the rate of burning. However, the change of vapor pressure alone cannot effect efficient evaporation of fuel and, accordingly, it is impossible to obtain a large rate of burning with a large amount of fuel.

To overcome this problem, it has been proposed to form a flame in the mixing chamber and to transmit the heat of the flame to the evaporation section thereby promoting evaporation of the liquid fuel. Unfortunately, this attempt has not been particularly successful because a relatively long time elapses before the burning is stabilized. This is due to the fact that the flame does not grow rapidly after ignition thereby producing a certain time lag before evaporation of the fuel. In addition, when the burner is turned off, the flame does not go out immediately so that evaporation of the fuel is continued thereby causing a lag in extinction of the fire. Further, the flame does not change smoothly when the burning rate is changed so that the burning rate cannot be changed linearly.

SUMMARY OF THE INVENTION

It is, therefore, a major object of the invention to provide an improved liquid fuel burner capable of overcoming the above-described problems of the prior art.

More specifically, it is an object of the invention to provide a liquid fuel burner capable of changing the burning rate over a wide range while maintaining a stable burning state and having a good response to ignition, extinction and burning rate controlling operations.

To these ends, according to the invention, there is provided a liquid fuel burner in which no flame is formed in the mixing chamber but, instead, a heater is provided for maintaining the porous member of the fuel evaporation section substantially at a constant temperature irrespective of the rate of evaporation of the liquid fuel from the porous member of the fuel evaporation section.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
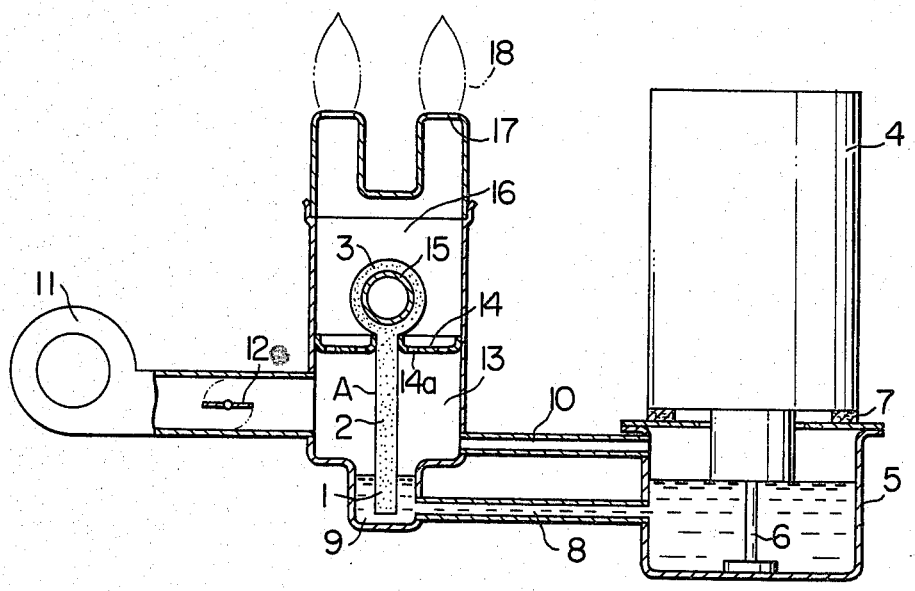
FIG. 1 is a sectional front elevational view of a liquid fuel burner constructed in accordance with a first embodiment of the invention.

Referring first to FIG. 1 showing a liquid fuel burner constructed in accordance with a first embodiment of the invention, the symbol A denotes a porous member having a multiplicity of pores and arranged to suck the liquid fuel by capillary action. This porous member has three sections: a fuel receiving section 1 for receiving the liquid fuel supplied to the burner, a sucking section 2 for sucking the liquid fuel and an evaporation section 3 in which the liquid fuel is evaporated. Reference numeral 4 denotes a cartridge tank for liquid fuel, while reference numeral 5 denotes a lower tank provided with a pin 6. Reference numerals 7, 8, 9 and 10 denote, respectively, a packing, a fuel supplying pipe, a fuel supplying chamber and an air balance pipe.

As the cartridge tank 4 is attached in the manner shown in FIG. 1, the pin 6 opens a valve (not shown) so that the liquid fuel is supplied to the lower tank 5 to a predetermined level. Then, as the level of the liquid fuel is lowered below the predetermined level as a result of burning of the fuel in the burner, the liquid fuel is automatically supplied from the cartridge tank 4 into the lower tank 5. The supply of the liquid fuel is stopped when the liquid level in the lower tank 5 reaches the predetermined level. Therefore, a substantially constant fuel level is maintained in the lower tank 5.

The fuel supplying chamber 9 communicates with the lower tank through the fuel supplying pipe 8 and the air balance pipe 10, so that the liquid fuel supplied from the cartridge tank 4 in accordance with the fuel consumption is maintained at a substantially constant fuel level therein.

The supply of the liquid fuel from the fuel supplying chamber 9 to the fuel evaporation section 3 is made by the capillary action of the porous member A. Therefore, the fuel is supplied at a rate precisely matching the rate of evaporation of the fuel, however the rate of evaporation of the fuel from the evaporation section 3 may be changed.

The air balance pipe 10 is provided for maintaining an equilibrium or balanced state between the air pressures acting on the fuel surfaces in the lower tank 5 and the fuel supplying section 9, respectively.

A reference numeral 11 denotes a blower as an example of air supplying devices, while a reference numeral 12 denotes a damper as an example of devices for adjusting the flow rate of air. Reference numerals 13 and 14 designate, respectively, a lower chamber and a partition plate. The partition plate 14 has bores 14*a*. The arrangement is such that the air supplied by the blower 11 is supplied at a rate adjusted by the damper 12 into the lower chamber 13 and further into the fuel evaporation section 3 through the bores 14*a* in the partition plate 14.

A reference numeral 15 denotes a heater as an example of heating devices, arranged for maintaining the temperature of the fuel evaporation section 3 at a previously designed level. Any practically usable heaters such as a combination of Ni-Cr wire and a temperature controlling circuit, a self-controlling heat generating member having a saturation level at a suitable temperature level and so forth can be used as the heater 15.

A mixing chamber 16 disposed at the downstream side of the fuel evaporation section 3 has a space in which the gaseous fuel evaporated from the evaporation section 3 is mixed with air. Reference numerals 17 and 18 designate, respectively, a flame section consisting of a multiplicity of ports or slits and a burning chamber.

In operation, as the heater 15 is energized, the fuel evaporation section 3 of the porous member A is heated to the aforementioned predetermined temperature. The blower 11 is started in this state so that the air is supplied to the evaporation section 3 through the bores 14*a* at a rate adjusted by the damper 12. Accordingly, in the evaporation section 3, the liquid fuel is evaporated at a rate corresponding to the rate of air supply and the resulting gaseous fuel is mixed with the air in the mixing chamber 16. The mixture is jetted from the flame section 17 into the burning section 18 so as to be burnt in the latter.

The vapor pressure around the fuel evaporation section 3 varies in accordance with the change of flow rate of air so that the liquid fuel is evaporated at a rate corresponding to the flow rate of air.

Although not shown, a porous metallic member is disposed in the flame section 17 so as to check any backfire from the burning chamber 18 so that no flame is formed in the mixing chamber 16.

The fuel evaporation section 3 is heated solely by the heater 15 which is arranged to always maintain the evaporation section 3 at a substantially constant temperature. Therefore, the liquid fuel contained in this evaporation section is maintained at a temperature which is suitable for evaporation. At the same time, the temperature of the evaporation section 3 is prevented from falling below the predetermined level due to the evaporation of the liquid fuel.

Consequently, the liquid fuel is smoothly evaporated from the fuel evaporation section 3 at a rate corresponding to the rate of supply of air to this section.

The heater 15 generates heat immediately after it is energized to heat and maintain the fuel evaporation section at a substantially constant temperature, thereby heating the liquid fuel to a temperature which facilitates the evaporation of the liquid fuel and prevents a drop in the temperature of the fuel evaporation section attributable to the evaporation of the fuel. Therefore, it is possible to obtain a fuel evaporation rate corresponding to the air supply rate in a very short period of time thereby achieving a rapid rise and stabilization of combustion, as compared with the conventional burner in which the evaporation section is heated by a flame formed in the mixing chamber.

In extinction of the fire on the burner, the heating of the fuel evaporation section 3 is stopped immediately after the power supplied to the heater 15 is cut off and the evaporation is stopped without delay. Thus, the burner of this embodiment permits a rapid stop of evaporation of the fuel from the fuel evaporation section 3 and, accordingly, a swift extinction of the fire, contributing greatly to the enhancement of safety, as compared with the conventional burner in which a flame is formed in the mixing chamber to heat the evaporation section.

Further, in controlling the rate of burning, the heat output from the heater 15 is automatically controlled to maintain the fuel evaporation section at a substantially constant temperature irrespective of a change in the burning rate so that the rate of evaporation of the fuel from the fuel evaporation section 3 is smoothly changed in accordance with a change in the rate of air supply to this section thereby varying the rate of burning. Such a function can never be achieved when the flame is formed in the mixing chamber as in the conventional burner.

Thus, the liquid fuel burner of the first embodiment offers various advantages such as rapid rise and stabilization of burning, swift fire extinction and smooth control of the burning rate, in comparison with the conventional burner in which the evaporation section is heated by means of the flame formed in the mixing chamber.

Figure 2:
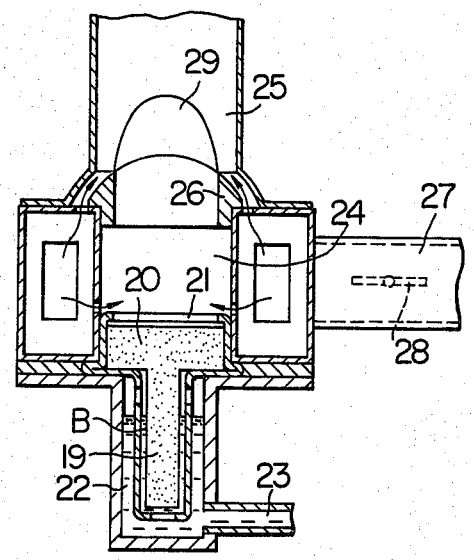
FIG. 2 is a sectional front elevational view of a liquid fuel burner constructed in accordance with a second embodiment of the invention.

FIG. 2 shows a liquid fuel burner constructed in accordance with a second embodiment of the invention.

A porous member B has a fuel receiving section 19 arranged for receiving a liquid fuel supplied thereto, a fuel sucking section 20 for sucking up the liquid fuel and a fuel evaporation section 21 for evaporating the liquid fuel. Reference numerals 22 and 23 denote, respectively, a liquid fuel supplying chamber and a liquid fuel supplying passage. A predetermined constant fuel level is preserved in the liquid fuel supplying chamber by a suitable measure. The supply of liquid fuel from the fuel supplying chamber 22 to the fuel evaporation section 21 is obtained by the capillary action of the porous member B so that the rate of supply of the liquid fuel to the evaporation section 21 always matches the rate of evaporation of fuel from the latter, however the rate of evaporation may be changed. The above-mentioned evaporation section 21 is made mainly of a metallic or non-metallic material arranged to generate heat when supplied with electric current and is shaped to have a diaphragm or layer permeable to air, and is arranged to evaporate at its surface the fuel coming through the fuel sucking section 19. The fuel evaporation section may be constituted by a woven structure of heating electric wires and insulating wires, or a foamed metal arranged to generate heat when supplied with electric current. In any case, it is preferred that the material constituting the fuel evaporation section have a self-controlling characteristic which controls the heat output to maintain a constant temperature. Further, it is possible to form the evaporation section with a material which generates heat by induction heating or dielectric heating.

A reference numeral 24 denotes a mixing chamber disposed at the downstream side of the fuel evaporation section 21, 25 denotes a burning chamber and 26 denotes a flame section disposed at the downstream side of the mixing chamber 24. The flame section 26 is made of a heat-resistant material such as a metal or ceramics with apertures or slits for permitting the mixture to flow therethrough, and has a shape suitable for burning the mixture gas in a burning space 29. An air supplying pipe 27 is provided with a damper 28 as an example of an air flow rate adjusting device. The air supplying pipe 27 is arranged to supply primary and secondary air to the mixing chamber 24 and the burning space 29, respectively, as shown by arrows.

In this second embodiment, the fuel evaporation section 21 itself plays the role of the heater 15 of the first embodiment. The operation of this burner is essentially identical to that of the first embodiment.

The heater 15 of the first embodiment and the fuel evaporation section 21 of the second embodiment used as the heating device are intended for both heating the liquid fuel to a temperature which facilitates and promotes evaporation and maintaining the fuel evaporation section 3,21 at an adequate temperature level, thereby overcoming the temperature drop attributable to evaporation of the fuel from the fuel evaporation section.

When it is desired to make the range of change of the burning rate as wide as possible and to preserve a proportionality between the rate of air supply and the rate of fuel evaporation, it is preferred to control the electric power supply in such a manner as to maintain the liquid fuel in the fuel evaporation secton 3, 21 at a substantially constant temperature.

For instance, when kerosene is used as the liquid fuel, it is desirable to maintain the liquid kerosene at a temperature ranging between 180° and 190° C. by suitably controlling the electric power supply. The temperature of the liquid fuel in the evaporation section preferably falls within the region of between 120° and 350° C. whatever the case may be. A liquid fuel temperature below 120° C. may cause a generation of tar-like substance, whereas a liquid fuel temperature exceeding 350° C. may cause a boiling of the liquid fuel resulting in an imbalance between the rate of supply of the primary air and the rate of burning or in an ignition of the fuel in the mixing chamber 16, 24.

The fuel evaporation section 3, 21 may become clogged with a tar-like substance being deposited thereon which hinders the supply of the liquid fuel. This problem, however, can be overcome very easily by supplying electric current to the heater 15 or to the evaporation section 21 itself, after stopping the supply of fuel, so as to heat and decompose the tar-like substance. To this end, it is preferred to provide a controller which permits an automatic or a manual control of the fuel and an electric current supply to heat the tar-like substance when the fuel evaporation section has become clogged with the latter.

In order to prevent a backfire into the mixing chamber 24, it is preferred to provide a porous member such as a metal gauze wire in the flame section 26.

Figure 3:
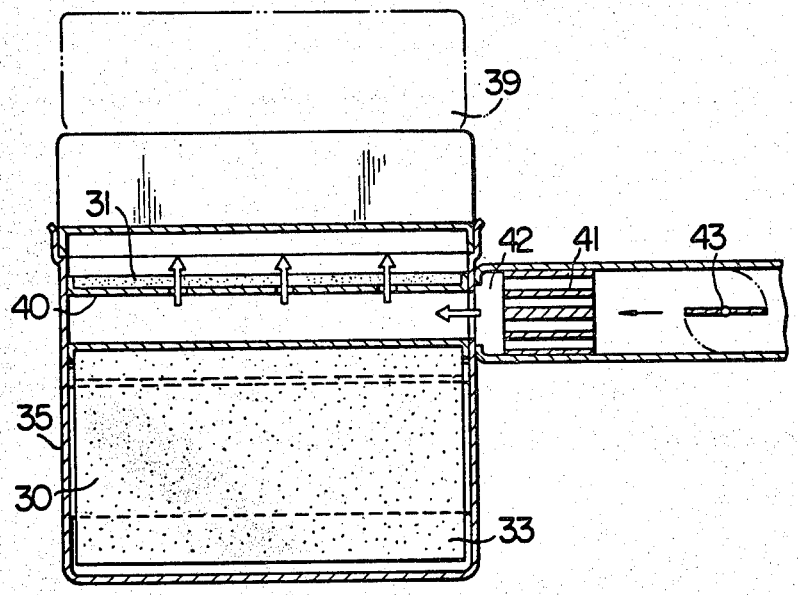
FIG. 3 is a sectional side elevational view of a liquid fuel burner constructed in accordance with a third embodiment of the invention.
Figure 4:
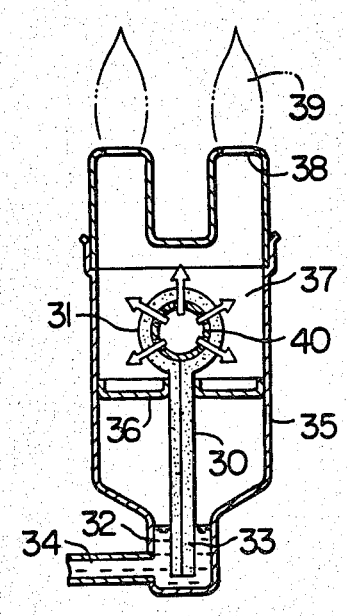
FIG. 4 is a sectional front elevational view of the liquid fuel burner of the third embodiment shown in FIG. 3.

Referring now to FIGS. 3 and 4 showing a liquid fuel burner constructed in accordance with a third embodiment of the invention, a reference numeral 30 denotes a porous member which is impregnated with the liquid fuel in the liquid state and having a fuel evaporation section 31. The material of this porous member 30 can be selected as desired from sintered powder material, foamed material, woven fibers and so forth which have a multiplicity of continuous pores for good impregnation and capillary action. A reference numeral 32 denotes a fuel supplying chamber arranged to supply the liquid fuel to the fuel receiving section 33 of the porous member 30. The liquid fuel is fed to this fuel supplying chamber 32 from a fuel tank (not shown) through a fuel supplying pipe 34. The liquid fuel fed to the fuel receiving section 33 is sucked up by the entire porous member 30 through a multiplicity of minute continuous pores. Reference numerals 35, 36 and 37 denote, respectively, a case, a partition plate and a mixing chamber. A flame section and a burning space are designated by reference numerals 38 and 39, respectively. A reference numeral 40 denotes a hot-air supplying pipe provided with a multiplicity of air passage ports. A heater 41 used as an example of the heating device preferably has a characteristic such that it heats the air to a substantially constant temperature irrespective of a change in the flow rate of the air or the temperature of the air before it is heated. For instance, a self-controlling electric heater having a honeycomb structure can be most suitably used as the heater 41. Reference numerals 42 and 43 denote, respectively, a hot-air passage and a damper used as an example of the device for adjusting the flow rate of air.

In the third embodiment of the invention shown in FIGS. 3 and 4, the flow rate of air supplied by a blower (not shown) is regulated and adjusted to a desired level by the damper 43. The air is then heated by the heater 41 to a substantially constant temperature. Thereafter, the hot air is made to pass through a multiplicity of air passage ports of the hot-air supplying pipe and to contact the impregnating liquid fuel in the fuel evaporation section 31 to evaporate the liquid fuel. The vapor of the fuel flows into the mixing chamber 37 together with the hot air and the mixture thereof flows through the flame section 38 into the burning space 39 so as to be burnt in the latter. The continuous pores of the porous member 30 perform a capillary action to suck up the liquid fuel to make up for the decrease of the fuel attributable to the evaporation from the evaporation section 31.

In FIGS. 3 and 4, single line arrows ← denotes the passage of air before heating, while double line arrow ⇐represents the passage of the heated air.

The liquid fuel is evaporated from the fuel evaporation section 31 at a rate corresponding to the rate of air supply to this section. Since this air is heated by the heater 41 to a constant temperature irrespective of the flow rate and initial temperature, the temperature of the evaporation section is maintained constant by the heat delivered by the hot air. The temperature of the fuel evaporation section 31 tends to be lowered in accordance with the rate of evaporation of the liquid fuel. However, since the rate of evaporation is proportional to the rate of supply of the hot air to this section, the fuel evaporation section 31 is heated at a rate corresponding to the rate of evaporation so that the temperature of the fuel evaporation section 31 is maintained at a substantially constant level.

Therefore, the liquid fuel burner of the third embodiment permits a rapid rise and stabilization of burning, as well as swift fire extinction, as in the case of the first embodiment.

Figure 5:
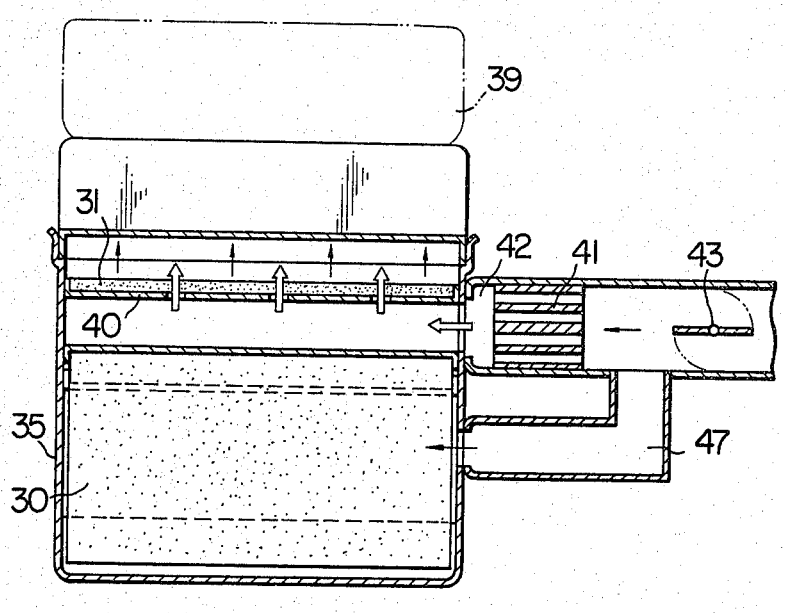
FIG. 5 is a sectional side elevational view of a liquid fuel burner constructed in accordance with a fourth embodiment of the invention.
Figure 6:
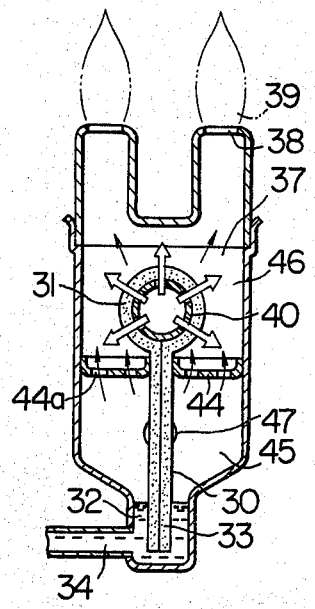
FIG. 6 is a sectional front elevational view of the liquid fuel burner of the fourth embodiment shown in FIG. 5.

FIGS. 5 and 6 show a liquid fuel burner constructed in accordance with a fourth embodiment of the invention. Since this fourth embodiment is quite similar to the third embodiment, parts and members constituting this fourth embodiment which are the same as those of the third embodiment are designated with the same reference numerals, and the description will be focussed upon only the points of difference.

In this embodiment, a lower chamber 45 and an upper chamber 46 defined at the lower and upper sides of a partition plate 44 communicate with each other through an aperture 44*a* formed in the partition plate 44. A reference numeral 47 denotes a cold air passage. The arrangement is such that the air which has passed the damper 43 is divided into a first fraction flowing through the hot air passage 42 and a second fraction which flows through the cold air passage 47. The second fraction of air flows into the lower chamber 45 and then into the upper chamber 46 through the aperture 44*a* of the partition plate 44 so as to be merged into the hot air supplied through the hot air passage 42 and the gaseous fuel evaporated from the fuel evaporation section 31. The air and the gaseous fuel then flow through the mixing chamber 37, the flame section 38 and then into the burning space 39 so as to be burned in the latter.

Although not exclusive, the ignition in the first, second, third and fourth embodiments can be provided by an electric discharge which generates sparks in the portion of the burning space 18, 29, 39 in the vicinity of the flame section 17, 38 and extinction of the flame is accomplished by cutting off the electric power supply to the heater 15, 41 or the fuel evaporation section 21 used as the heating device.

Figure 7:
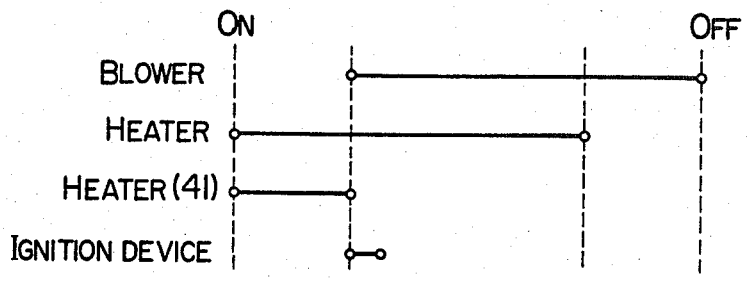
FIG. 7 is an illustration of a controlling operation.

In order to shorten the time required for the ignition in the third and fourth embodiments, it is possible to use a separate heater, which may be similar to heater 15 of the first embodiment, for directly heating the fuel evaporation section 31 through the control of the power supply to this heater in a manner schematically shown in FIG. 7.

More specifically, as the electric power switch is turned on, the above-mentioned heater and the heater 41 are simultaneously energized so that the fuel evaporation section 31 is heated directly by the heat produced by the separate heater. Then, as the temperature of the fuel evaporation section 31 stabilizes, the blower is started so that the hot air heated by the heater 41 is supplied to the fuel evaporation section 31. Then, the hot air is mixed with the gaseous fuel evaporated from the fuel evaporation section 31 and is ignited by the igniter to commence the burning.

Figure 8:
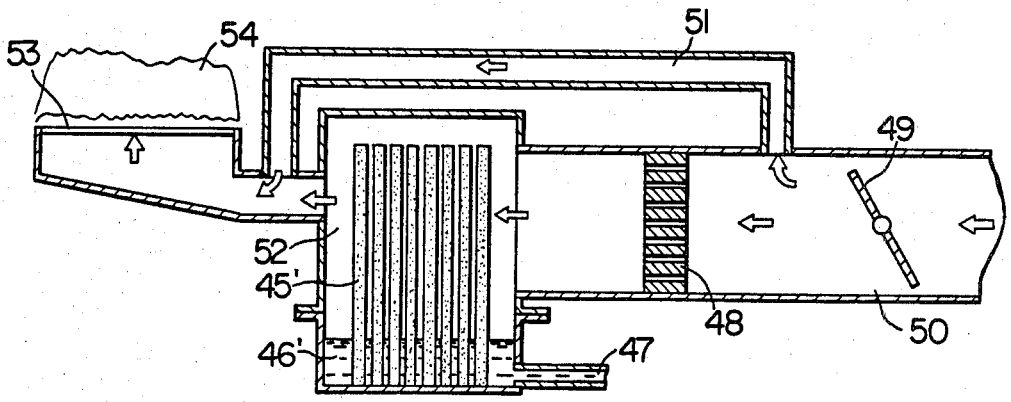
FIG. 8 is a sectional front elevational view of a liquid fuel burner constructed in accordance with a fifth embodiment of the invention.

FIG. 8 shows a fifth embodiment of the invention in which a reference numeral 45' denotes a porous member having a rod-like shape, while a reference numeral 46' denotes a fuel supplying chamber. Numerals 47, 48 and 49 denote, respectively, a fuel supplying pipe, a heater used as an example of the heating device and a damper used as an example of the device for adjusting the flow rate of air. An air supplying pipe, a cold air passage and a mixing chamber are designated by numerals 50, 51 and 52, respectively. Reference numerals 53 and 54 denote a flame section and a burning space. The characteristic feature of this fifth embodiment resides in the provision of a cold air passage 51. Other portions provide substantially the same effects as those of the preceding embodiments.

Namely, in this embodiment, a part of the cold air, before entering the heater 48 is shunted from the main flow and is merged into the mixture of the hot air and the gaseous fuel evaporated by this hot air, at the upstream side of the flame section 53, thereby lowering the temperature of the mixture to prevent a backfire from the flame section 53.

Figure 9:
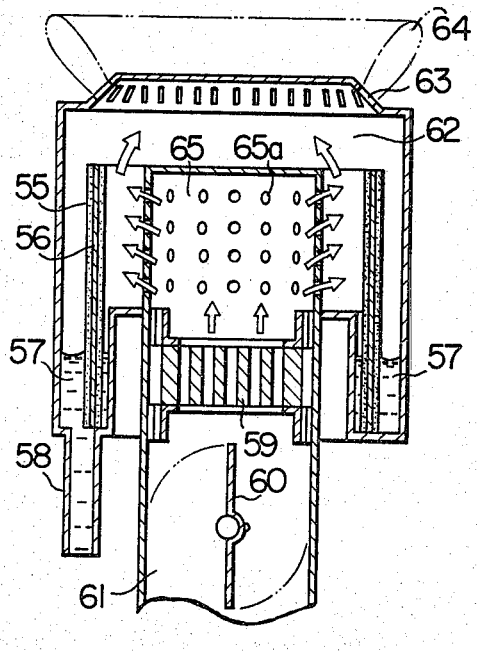
FIG. 9 is a sectional front elevational view of a liquid fuel burner constructed in accordance with a sixth embodiment of the invention.

FIG. 9 shows a sixth embodiment of the invention in which a reference numeral 55 denotes a porous member attached to both the inner and outer surfaces of a cylindrical punching plate 56, while a reference numeral 57 denotes an annular fuel supplying chamber. A reference numeral 58 denotes a fuel supplying pipe, 59 denotes a heater used as an example of the heating device and 60 denotes a damper used as an example of the device for adjusting the flow rate of the air. Reference numerals 61, 62 and 63 denote, respectively, an air supplying pipe, a mixing chamber and a flame section. A burning space is designated at a reference numeral 64. A reference numeral 65 denotes a member for jetting hot air. The major characteristic of this sixth embodiment resides in this hot air jetting member 65. Other portions operate substantially in the same manner as the preceding embodiments.

The hot air jetting member 65 is constituted by a cylindrical member having a plurality of apertures 65*a* through which heated air is jetted uniformly over the entire cylindrical porous member 56 to obtain a uniform evaporation of fuel over the entire area of the porous member 56.

Figure 10:
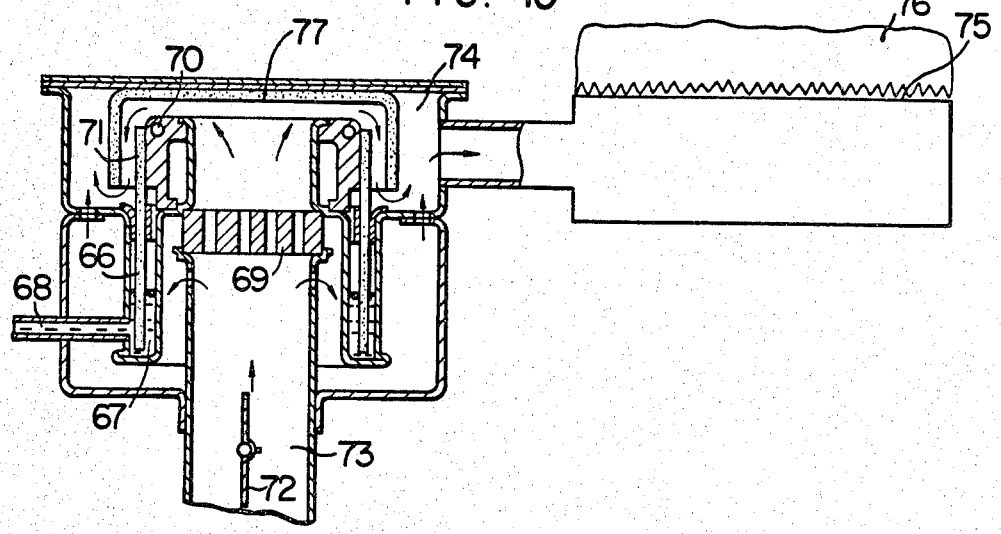
FIG. 10 is a sectional front elevational view of a liquid fuel burner constructed in accordance with a seventh embodiment of the invention.

Referring now to FIG. 10 showing a seventh embodiment of the invention, reference numeral 66 denotes a cylindrical porous member, 67 a fuel supplying chamber, 68 a fuel supplying pipe, 69 a heater used as an example of the heating device, 70 a heater for heating the fuel evaporation section 71 of the porous member 66, 72 a damper used as an example of the device for adjusting the flow rate of the air, 73 an air supplying pipe, 74 a mixing chamber, 75 a flame section, 76 a burning space and 77 denotes an air deflecting plate.

The principal feature of this seventh embodiment resides in the provision of the air deflecting plate. Namely, the hot air heated by the heater 69 and flowing upward is deflected by the air deflecting plate so that the air flows downwardly from the upper side of the fuel evaporation section, thereby preventing the undesirable deposition of tar-like substance on the upper part of the fuel evaporation section 71. To explain in more detail, the components of the liquid fuel having high boiling temperatures are less likely to be evaporated and tend to be sucked up to and deposited at the upper part of the fuel evaporation section 71. This, however, is adequately avoided in the described embodiment because the heated air of high temperature is blown onto the upper part of the fuel evaporation section 71 from the upper side of the latter so that the components having high boiling temperatures are easily evaporated to prevent an accumulation of a tar-like substance.

Figure 11:
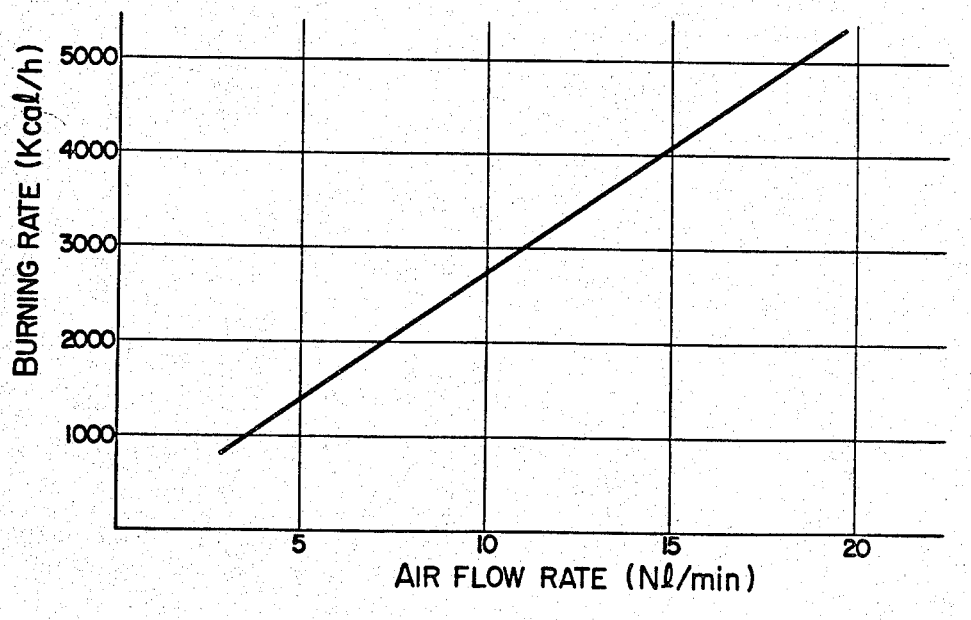
FIGS. 11 to 13 are characteristic diagrams, showing the characteristics of the liquid fuel burner of the invention.
Figure 12:
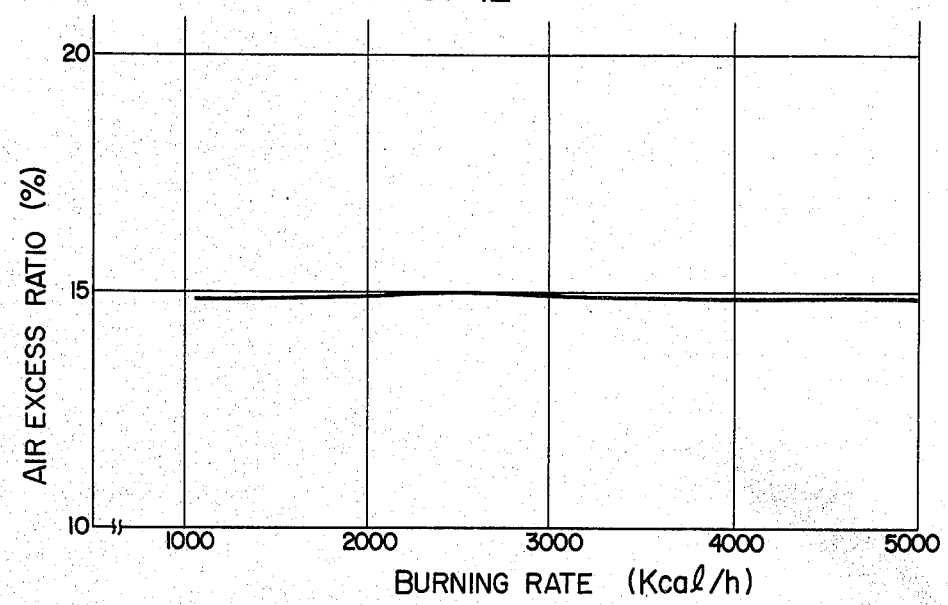
Figure 13:
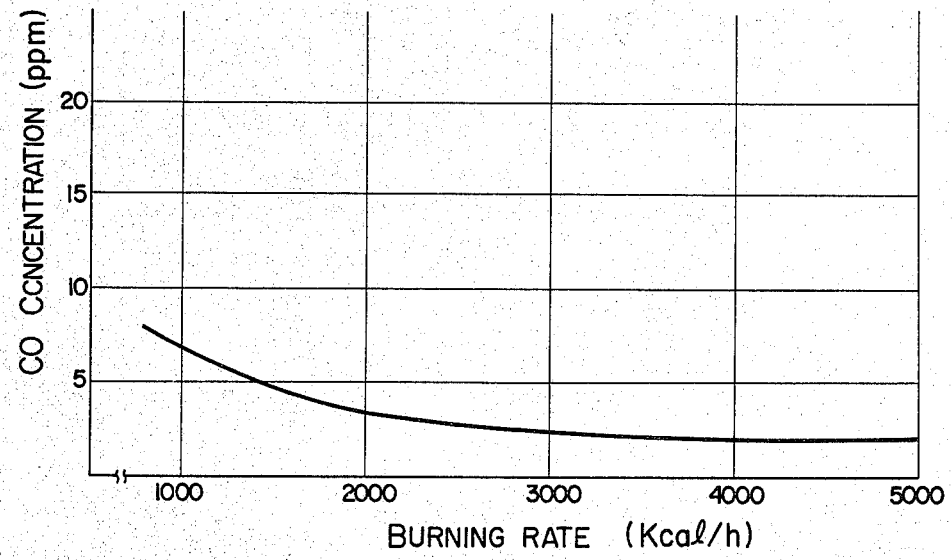

The advantages brought about by the invention will be readily understood from the following description taken in conjunction with FIGS. 11, 12 and 13 showing representative characteristics of the liquid fuel burners of the invention.

In the liquid fuel burner of the invention, the rate of burning (rate of evaporation of liquid fuel) is changed in proportion to the rate of supply of air to the fuel evaporation section of the porous member, so that a substantially constant air-fuel ratio is maintained irrespective of the change in the burning rate to ensure a stable and good burning of the liquid fuel. Namely, according to the invention, the vapor pressure around the fuel evaporation section is changed in accordance with the change of the rate of air supply to the fuel evaporation section. More specifically, when the air is supplied at a large rate, the vapor pressure is lowered to permit an evaporation of fuel at a large rate, whereas, when the rate of air supply is small, the vapor pressure is increased to permit only a small rate of evaporation of the liquid fuel.

Therefore, the flow rate of air and the rate of burning are maintained substantially in proportion to each other as shown in FIG. 11. Also, the air-excess ratio (a factor equivalent to air-fuel ratio) is maintained substantially constant over a wide range of variation of the burning rate.

Further, since the liquid fuel burner of the invention is provided with a heating device for maintaining a substantially constant temperature of the fuel evaporation section irrespective of the change of evaporation rate of the liquid fuel, the temperature of the mixture of air and gaseous fuel is also maintained constant independently of the change in the burning rate.

These features in combination ensure a good state of burning irrespective of the change in the burning rate. In fact, the carbon and hydrocarbon contents are substantially zero over the whole range of burning rate, and the carbon monoxide concentration is maintained at an extremely low level as will be understood from FIG. 13 at any burning rate. In FIG. 13, a slight increase of the carbon monoxide concentration is observed in the region of small burning rate. This is attributed to the fact that, in such region of small burning rate, the size of the flame is so small that the outer surface area of the flame is cooled by the ambient air.

In addition, since the air-fuel ratio and temperature of the mixture are maintained substantially constant irrespective of the change of the burning rate as stated before, it has become possible to effect, without any problem or defect, a control of the burning rate over a wide range of between 1/5 and 1/1 merely by selecting the construction of the flame section from those which have been put into practical use.

A construction of the flame section which would hold the flame stably against the change of flow velocity of the mixture corresponding to the change of burning rate between 1/5 and 1/1 can easily be selected from constructions which are now practically used and commercially available.

According to the invention, the liquid fuel burner has a heating device for heating and maintaining the fuel evaporation section at a substantially constant temperature, and the evaporation of the liquid fuel from this section is facilitated and promoted to permit burning at a high rate with a large amount of vaporized fuel.

Further, in contrast to the conventional liquid fuel burner in which the fuel evaporation section is heated by a flame formed in the mixing chamber, the fuel evaporation section of the liquid fuel burner of the invention is directly and rapidly heated without delay after supplying electric current to the heating device. As a result, the evaporation of the fuel is commenced without delay to permit a rapid rise and stabilization of the burning. To extinguish the fire, the evaporation of the liquid fuel is swiftly stopped by simply removing electric power supply to the heating device so that the extinction occurs quite quickly without any danger. Also, the control or change of the burning rate is effected in a very smooth manner.

Moreover, since the burning rate is changed by changing the rate of air supply to the fuel evaporation section of the porous member, the aforementioned problems of the prior art which resulted from the use of a fuel adjusting device are completely eliminated.

Finally, in the liquid fuel burner of the invention, the liquid fuel is supplied to the fuel evaporation section at a rate matching the rate of evaporation of liquid fuel therefrom. This is due to the capillary action performed by the continuous pores of the porous member; however, the burning rate may be changed. Therefore, the undesirable spill or flooding of the fuel is fairly avoided thereby contributing greatly to the enhancement of safety.

Although the invention has been described through its preferred forms, it is to be noted that the described embodiments are not exclusive, and various changes and modifications may be imparted thereto without departing from the spirit and scope of the invention which are limited solely by the appended claims.

What is claimed is:

1. A liquid fuel burner comprising:

a porous member including at least a fuel receiving section for receiving liquid fuel and a fuel evaporation section for evaporating liquid fuel transferred from said fuel receiving section;

a fuel supplying device for supplying said liquid fuel to the fuel receiving section of said porous member;

a hot air supply pipe having a multiplicity of air passage ports therein surrounded by the fuel evaporation section of said porous member, air from said pipe passing through said ports into said fuel evaporation section;

an air-flow rate adjusting device located within said hot air supply pipe, said adjusting device controlling the rate at which air is supplied to said fuel evaporation section;

a heater for heating air within said hot air supply pipe to a substantially constant temperature for supply to said fuel evaporation section, said constant temperature being independent of a change in the air flow rate and the temperature of the air before heating;

a mixing chamber disposed downstream from the fuel evaporation section of said porous member, the hot air supplied to said fuel evaporation section and the gaseous fuel evaporated from said fuel evaporation section by said hot air being mixed without burning in said mixing chamber; and a burning space disposed downstream from said mixing chamber for burning the mixture evaporating from said mixing chamber, said heater maintaining said fuel evaporation section at a constant temperature after ignition of said fuel in said burning space irrespective of changes in the rate of evaporation of said fuel from said fuel evaporation section.

2. A liquid fuel burner as claimed in claim 1 which further comprises a case; and a partition plate positioned within said case to form lower and upper chambers, said plate having an aperture therein for receiving said porous member, the fuel receiving section of said porous member being located in said lower chamber and the fuel evaporation section in said upper chamber.

3. A liquid fuel burner as claimed in claim 2, characterized in that said partition plate is provided with an aperture and that cold air is supplied into said lower chamber.

4. A liquid fuel burner as claimed in claim 3, wherein said cold air is shunted from the air supplied by said air supplying device to said fuel evaporation section of said porous member.

* * * * *